US010183795B2

(12) United States Patent
Gamble et al.

(10) Patent No.: US 10,183,795 B2
(45) Date of Patent: Jan. 22, 2019

(54) REMOVABLE CAN HOLDING REFRIGERATOR CONTAINER

(71) Applicant: Danby Products Limited, Guelph (CA)

(72) Inventors: Shauna Gamble, Guelph (CA); Gregory Allan Thomas Hall, Guelph (CA); Michael Joseph DeFazio, Waterloo (CA); Steven Henry Fyke, Waterloo (CA); Brent Wayne Thomas, Waterloo (CA)

(73) Assignee: DANBY PRODUCTS LIMITED, Guelph (CA)

( * ) Notice: Subject to any disclaimer, the term of this patent is extended or adjusted under 35 U.S.C. 154(b) by 0 days.

(21) Appl. No.: 15/591,732

(22) Filed: May 10, 2017

(65) Prior Publication Data

US 2017/0341838 A1 Nov. 30, 2017

Related U.S. Application Data

(60) Provisional application No. 62/342,524, filed on May 27, 2016.

(51) Int. Cl.

| | |
|---|---|
| ***B65D 5/00*** | (2006.01) |
| ***B65D 71/52*** | (2006.01) |
| ***A47G 23/02*** | (2006.01) |
| ***B65D 25/06*** | (2006.01) |
| ***B65D 25/28*** | (2006.01) |
| ***B65D 25/30*** | (2006.01) |
| ***B65D 39/00*** | (2006.01) |

(52) U.S. Cl.

CPC ..... *B65D 71/0003* (2013.01); *A47G 23/0266* (2013.01); *B65D 25/06* (2013.01); *B65D 25/2823* (2013.01); *B65D 25/30* (2013.01); *B65D 39/00* (2013.01); *B65D 2501/24222* (2013.01); *B65D 2501/24261* (2013.01); *B65D 2501/24401* (2013.01)

(58) Field of Classification Search

USPC ..... 206/427, 429, 162; 248/148; 220/592.23, 592.16, 592.18, 592.2, 220/592.15, 592.01

See application file for complete search history.

(56) References Cited

U.S. PATENT DOCUMENTS

| | | | | |
|---|---|---|---|---|
| 2,069,997 A * | 2/1937 | Carr | B65D 5/4608 | 206/140 |
| 2,161,295 A * | 6/1939 | Hirschberg | B65D 81/3834 | 220/23.87 |
| 2,555,102 A * | 5/1951 | Anderson | B65D 71/0014 | 206/202 |
| 3,135,445 A * | 6/1964 | Reifers | B65D 5/4803 | 206/160 |
| 3,367,529 A * | 2/1968 | Welch | A47J 47/16 | 206/162 |
| 3,401,535 A * | 9/1968 | Palmer | F25D 3/00 | 206/139 |

(Continued)

*Primary Examiner* — Jacob K Ackun

(74) *Attorney, Agent, or Firm* — Ralph E. Jocke; Walker & Jocke

(57) ABSTRACT

A beverage can holding container (20) is removably positionable within an interior area (12) of a refrigerator (10). The container has an interior area (36) that holds a plurality of beverage cans (22). A plurality of handles (46, 58, 60) are provided to facilitate removing the container from the refrigerator and transporting the container with the beverage cans therein to a location away from the refrigerator where the beverages will be consumed.

27 Claims, 14 Drawing Sheets

(56) References Cited

U.S. PATENT DOCUMENTS 3,453,033 A * 7/1969 Goss ..... B67D 3/00 220/495.05
3,506,154 A * 4/1970 Barnes ..... B29C 41/025 206/509
3,612,336 A * 10/1971 Wilkich ..... B65D 81/00 206/162
3,974,658 A * 8/1976 Starrett ..... B65D 25/02 206/427
4,515,334 A * 5/1985 Horne ..... A47B 73/00 211/74
4,819,793 A * 4/1989 Willard ..... A45C 3/04 206/162
4,883,169 A * 11/1989 Flanagan, Jr. ..... B65D 71/0003 206/170
5,257,509 A * 11/1993 Harris ..... A45C 3/02 150/106
5,273,175 A * 12/1993 Apps ..... B65D 1/243 206/203
5,310,073 A * 5/1994 Johannsson ..... A22B 7/008 220/254.3
5,507,543 A * 4/1996 Shefflin ..... B65D 1/243 206/427
5,584,431 A * 12/1996 Clement ..... A47F 5/0025 211/71.01
5,788,117 A * 8/1998 Zimmanck ..... A47F 1/08 211/59.2
6,050,104 A * 4/2000 Corona ..... A47G 23/0241 220/592.01
6,554,159 B1 * 4/2003 Behr ..... A47F 1/08 206/427
7,334,684 B1 * 2/2008 Fontanilla ..... A45C 11/20 190/110
7,762,394 B2 * 7/2010 Bradford ..... B25J 7/00 206/427
2008/0083629 A1 * 4/2008 Soucie ..... A45C 3/04 206/170
2008/0217342 A1 * 9/2008 Cinque ..... A47J 41/0044 220/592.2
2009/0314663 A1 * 12/2009 Holley, Jr. ..... B65D 5/48038 206/139
2013/0112694 A1 * 5/2013 Bentley ..... F25D 3/08 220/592.2
2014/0284289 A1 * 9/2014 Perez ..... A47B 73/00 211/49.1
2016/0251132 A1 * 9/2016 Peel ..... B65D 71/0003 206/427

* cited by examiner

REMOVABLE CAN HOLDING REFRIGERATOR CONTAINER

TECHNICAL FIELD

Exemplary embodiments relate to refrigerators. Specifically an exemplary embodiment refers to a refrigerator with a removable can holding container that enables removing a plurality of beverage holding cans from the interior of the refrigerator for transport as well as placing a plurality of beverage holding cans within the container within the interior of the refrigerator.

BACKGROUND

Refrigerators are designed to for keeping food and beverages below ambient temperatures. Beverage holding cans and bottles are commonly stored in refrigerators. The beverage holding cans and bottles are positioned within the refrigerator so that they can be readily removed one at a time therefrom as they are used. However, it can be awkward to remove and carry several separate beverage holding cans or bottles from the refrigerator. Further, once the cans or bottles have been removed from the refrigerator, they often become warmer very quickly.

Refrigerators may benefit from improvements.

SUMMARY OF THE DISCLOSURE

Exemplary embodiments relate to a refrigerator which has a removable container therein. The container has an interior area that is configured to hold a plurality of beverage cans or bottles. For purposes of this disclosure, any reference to cans shall be deemed to include bottles as well. The interior area includes at least one divider which engages the beverage cans and urges each can to be positioned with its central axis aligned with the other cans in the container and perpendicular to an opening to the interior area of the container. An exemplary container includes a housing with ramp surfaces that are configured so that when the container is on a horizontal shelf surface within the refrigerator, the beverage cans are slanted downward and inward toward a closure wall side of the container opposed to the opening.

The exemplary container includes a plurality of handles that enable the container to be manually grasped and pulled out and upwardly from the interior area of the refrigerator. The exemplary handles are configured so that the beverage holding container can be readily carried when it is fully or partially loaded with beverage cans. The exemplary container is also configured so that ice or other coolant material can be packed inside the container with the beverage cans to help keep the beverages cool when the container is outside the refrigerator. An exemplary container also includes at least one removable divider so that the interior area of the container can be readily cleaned. An exemplary embodiment further includes a drain opening with a removable drain plug so that water or other liquid in the container can be drained.

DETAILED DESCRIPTION

Figure 1:
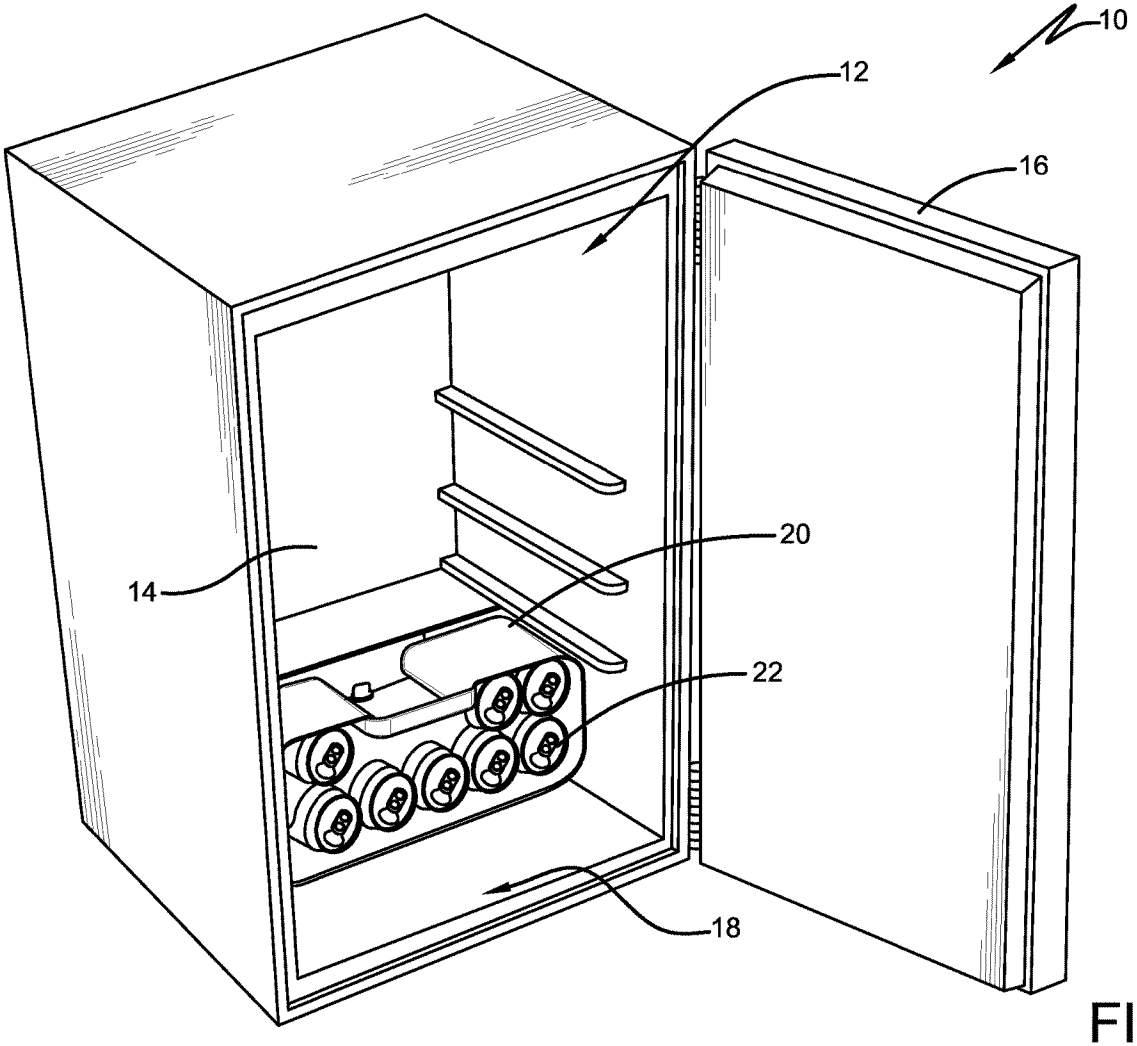
FIG. 1 is a right top perspective view of a refrigerator with an exemplary removable beverage can holding container positioned therein.

Referring now to the drawings and particularly to FIG. 1, there is shown therein an exemplary refrigerator 10. Refrigerator 10 has a refrigerator interior 12. The refrigerator interior has an opening 14. The refrigerator opening 14 can be selectively opened and closed by a door 16.

The refrigerator interior 12 includes a horizontally extending shelf surface 18. An exemplary embodiment of the removable beverage can holding container 20 is supported on the shelf surface 18. The beverage can holding container 20 holds a plurality of beverage cans 22. In an exemplary embodiment, the container is configured to hold 10 beverage cans. However, this configuration is exemplary and in other embodiments, other approaches may be used.

Figure 2:
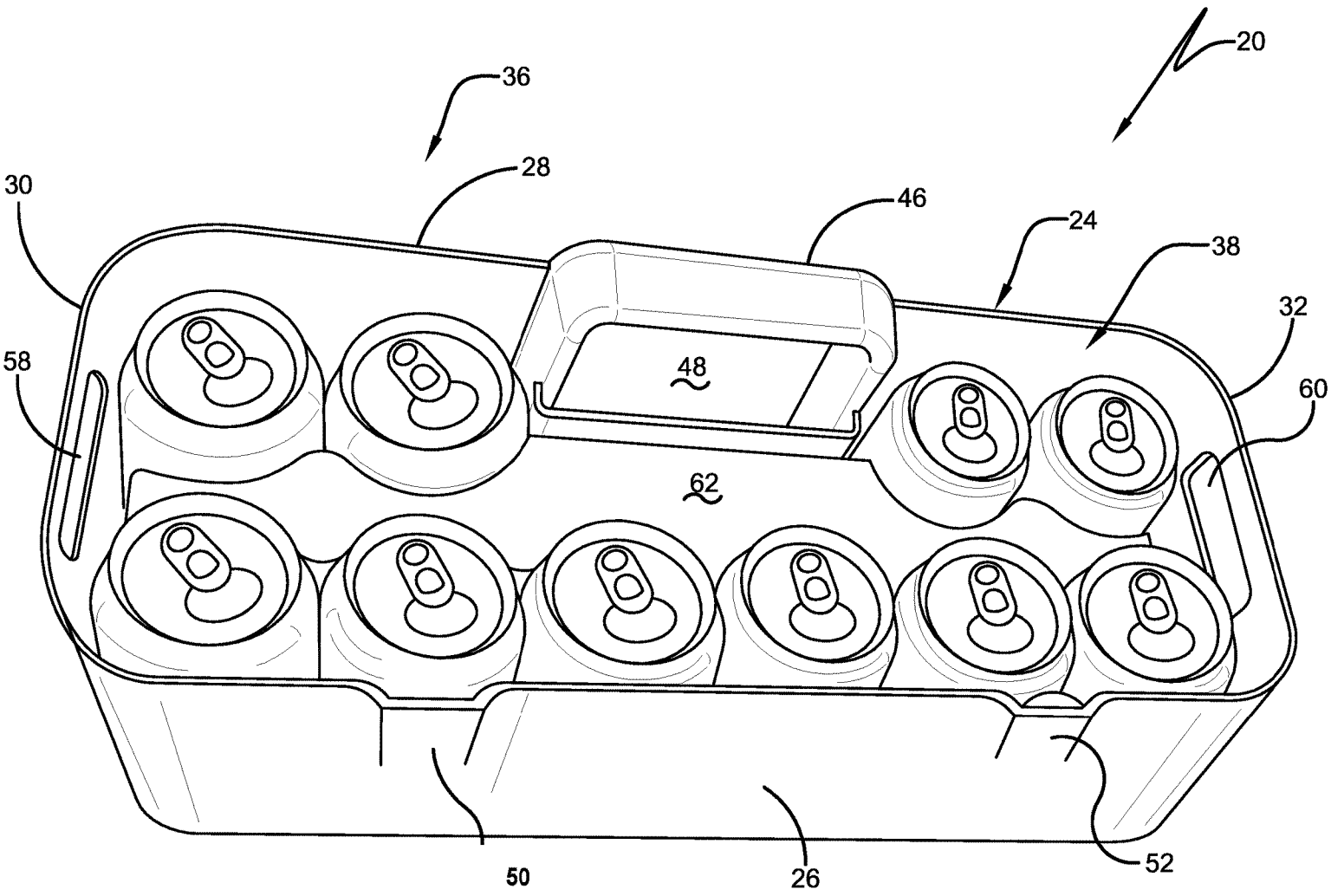
FIG. 2 is a top left perspective view of the exemplary beverage can holding container with beverage cans positioned therein.

As shown in FIG. 2, the exemplary container 20 includes a housing 24. The exemplary housing 24 is comprised of a plurality of generally rigid plastic walls. In the exemplary arrangement, the walls are integrated to form a continuous unitary wall construction so as to provide an integral plastic housing. Of course it should be understood that this approach is exemplary and in other embodiments, other approaches may be used.

Figure 7:
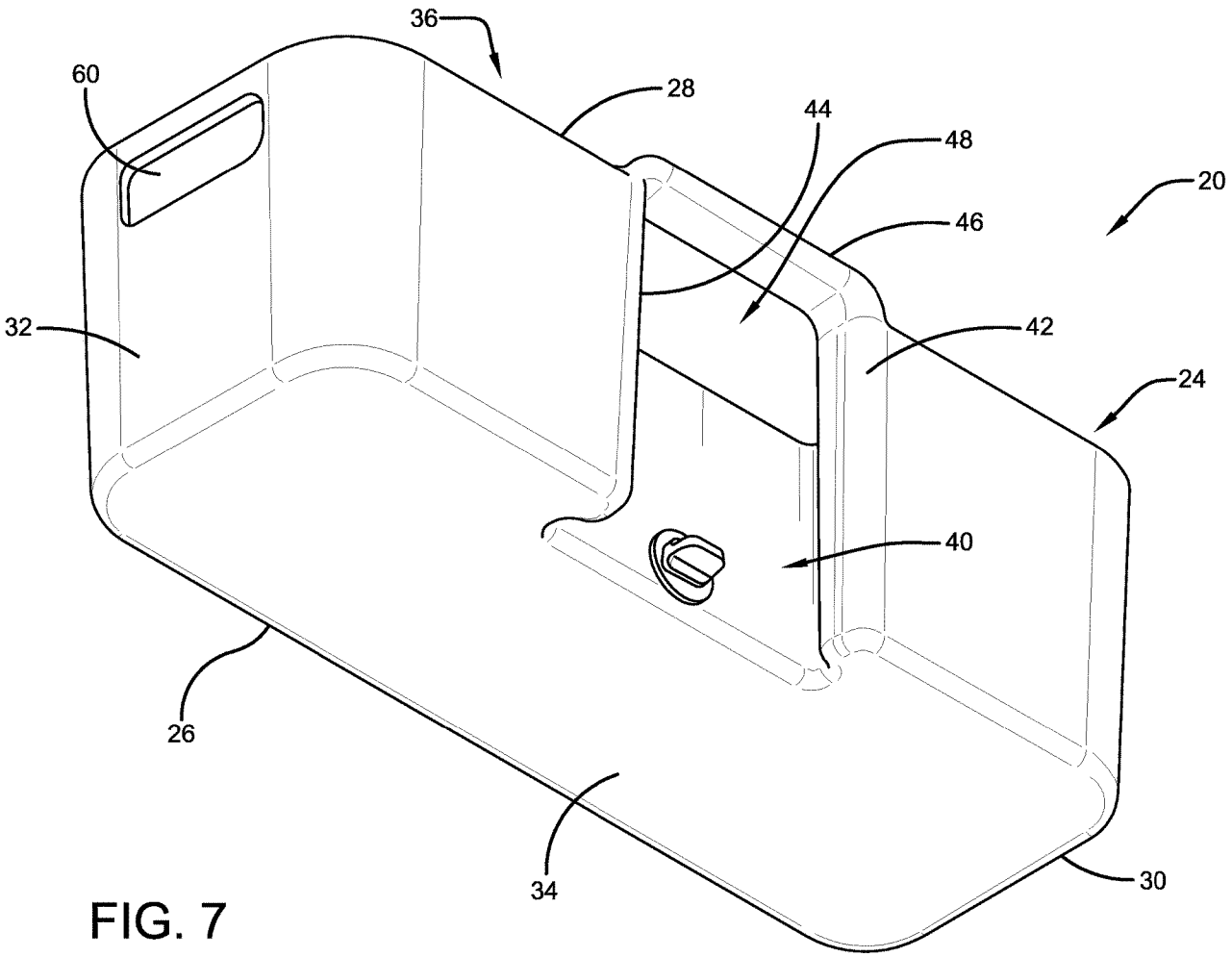
FIG. 7 is a back right top perspective view of the beverage can holding container.

In the exemplary arrangement, the housing 24 includes a first wall 26. A second wall 28 extends generally parallel to the first wall 26. The housing further includes a first end wall 30. The first end wall 30 extends between walls 26 and 28 and is generally perpendicular thereto. A second end wall 32 extends between walls 26 and 28 and is disposed at the opposite end of the housing 24 from end wall 30. A closure wall 34 (see FIG. 7) extends between the walls 26, 28, 30 and 32. In the exemplary arrangement, the housing 24 bounds an interior area 36. The housing includes an opening 38 to the interior area that extends on the side opposite the closure wall 34.

In the exemplary arrangement, wall 28 includes a recess 40 therein. The recess 40 is bounded by a pair abounding walls 42, 44. The bounding walls extend generally parallel to the end wall 30 and 32 and cause the recess to extend inwardly in the interior area 36. In the exemplary embodiment, a handle 46 is integrally formed with the bounding walls 42, 44 and extends therebetween above an opening 48 in the recess. In the exemplary embodiment, this arrangement facilitates manually grasping the handle 46 so that the container 20 can be readily moved horizontally in supported connection with a horizontal shelf, and upward and outward from the interior area of the refrigerator. Stated another way, the container 22 is removable from the refrigerator by manual engagement of the handle 46 integrally formed with the bounding walls 44 and 42. Of course it should be understood that this approach is exemplary and in other arrangements, other approaches may be used.

Figure 9:
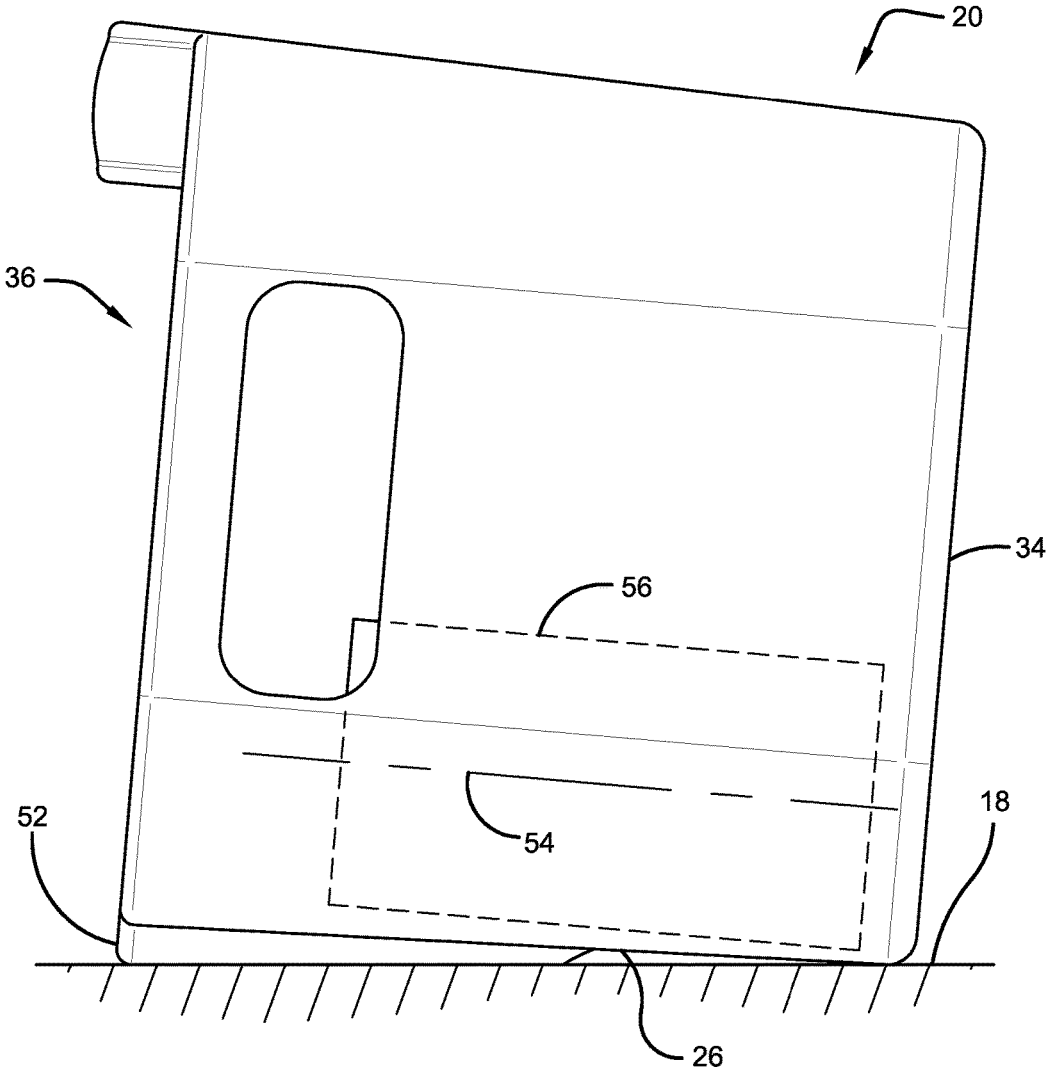
FIG. 9 is a side view of the exemplary beverage can holding container supported on a horizontal supporting surface.

The exemplary housing 24 further includes ramp surfaces 50 and 52. The ramp surfaces 50 and 52 are integrally formed with the container housing. The housing 24 includes a first wall 26 and second wall 28.In the exemplary embodiment shown, the ramp surfaces extend outwardly relative to an exterior surface of wall 26 on a side of the housing and the interior area 36. In the exemplary arrangement, the ramp surfaces are configured so that when the wall 26 is in supported engagement with. a generally horizontal support, such as the horizontal shelf surface 18 within the refrigerator, the beverage containing cans in the interior area of the container are caused to be positioned such that an axis 54 of each can, such as can 56 shown in phantom in FIG. 9, is slanted downward at an acute angle which is generally a relatively small angle but that in some embodiments may be as great as about 45 degrees toward the closure wall 34. It should be understood that in the exemplary embodiment shown, a can within the interior area 36 of the container 20 is caused to be slanted toward the closure wall by engagement of an interior can supporting face on the inside of the wall 26. With the housing and ramp surfaces positioned in engagement with the shelf surface, the exemplary closure surface extends generally perpendicular to the shelf surface. In the exemplary arrangement, this interior supporting face is a generally planar face. In other embodiments, other can supporting faces may be operatively engaged with the container walls and with the cans to impart the desired slant orientation to the can configuration. This may include, for example, divider structures internal of the housing which have can supporting faces 77 that are slanted in a manner that causes the cans to he urged to be moved toward the closure wall surface even when an outer wall of the housing is flush with a horizontal support surface or other surface within the refrigerator.

As can be appreciated, this exemplary arrangement of slanting the cans in the interior area toward the closure wall interior surface is useful as it generally prevents the cans from falling out of the interior area 36 unless they are manually grasped and horizontally moved therefrom. Further, any vibration that is experienced through operation of the refrigerator or other factors, will tend to cause the cans to move toward the interior face of the closure wall 34 of the housing 24, rather than move out through the opening 38 of the container. Of course it should be understood that this approach is exemplary and in other arrangements, other approaches may be used.

The exemplary container further includes handles 58 and 60. Handles 58 and 60 include a handle engaging opening in end walls 30 and 32 respectively. Handle engaging openings are configured to enable a user to manually grasp the handle to facilitate carrying the container 20 by the end walls. This provides an alternative way for a user to carry the container using two hands rather than carrying the container with one hand by the central handle 46. Of course it should be understood that these approaches are exemplary and in other embodiments, other approaches may be used.

In the exemplary embodiment, at least one divider 62 is removably positioned in the interior area 36 of the container. In the exemplary embodiment as shown, the divider 62 causes the interior area to be divided into a plurality of recesses 64 which are each configured to removably receive a beverage holding can. In the exemplary arrangement, the divider 62 includes a central portion 66 which separates the cans into two rows within the interior area. The exemplary divider further includes peripheral portions 68 which extend adjacent to the interior surfaces of the walls which make up the housing and help to separate the beverage cans adjacent to such wall surfaces.

In the exemplary embodiment, the at least one divider is configured to engage the beverage holding cans and urge the cans to be positioned so that the central axis thereof extends perpendicular to the closure wall and the container opening. Further the exemplary one or more dividers are made so that some or all can be removed from the interior area of the container so as to facilitate the cleaning thereof Additionally in exemplary arrangements, the central portion 66 of the divider is positioned so that it is disposed inwardly toward the closure wall relative to the top surfaces of the beverage cans which are housed therein. This enables the container to be filled with ice or other cooling materials such as gel packs, etc. after the beverage holding container has been removed from the interior of the refrigerator. The container can include the ice or cooling material while it is carried by the user to the location where the beverages will be consumed. As can be appreciated, this ability of the exemplary arrangement to hold ice or other cooling material when it is outside the refrigerator facilitates carrying a plurality of beverage cans to a remote location away from the refrigerator.

Figure 6:
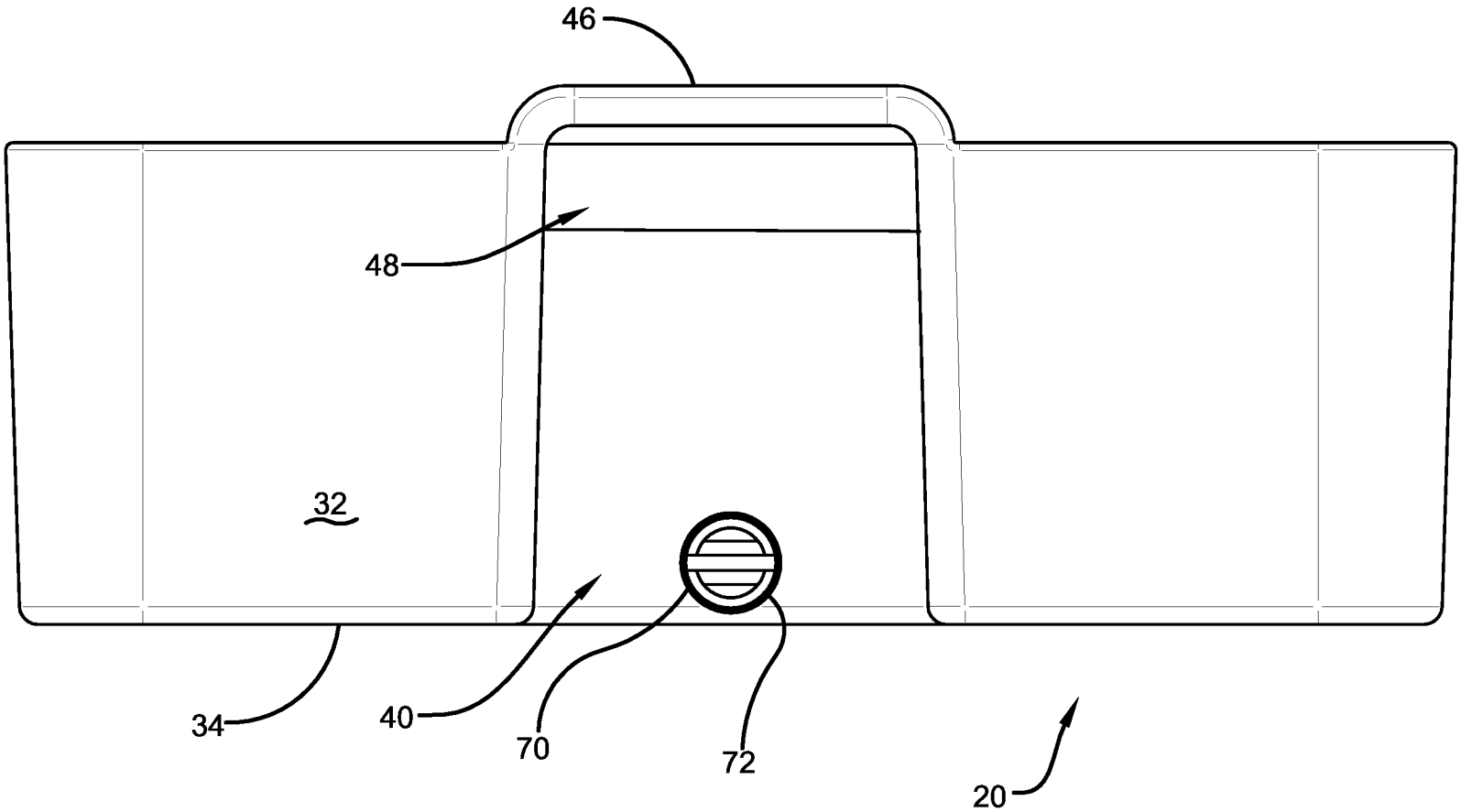
FIG. 6 is a top view of the exemplary beverage can holding container.

In an exemplary arrangement as shown in FIG. 6, the wall 32 in the area of the recess 40 includes a drain opening 70. The drain opening 70 is positioned adjacent to a closure wall 34 and extends into the interior area of the container. The drain opening 70 is configured to be selectively closed by a movable drain plug 72. In some arrangements the movable drain plug can be moved between open and closed positions and in other arrangements, the plug may be totally removed from the opening. The movable drain plug is configured so that water from ice that is melted within the interior area of the container or spilled beverages or the like, can be readily removed from the container interior area by moving and opening the drain plug. Further, moving or removing the drain plug may facilitate cleaning the interior area of the container. Further it should be understood that while only one drain plug is shown in the exemplary embodiment, in other embodiments a single container wall may include multiple openings and drain plugs, or multiple walls may include such selectively accessible openings.

FIGS. 10-14 show the exemplary container 20 with an alternative divider 74 therein. The exemplary divider 74 is similar to the previously discussed divider 62 except as described herein.

Figure 12:
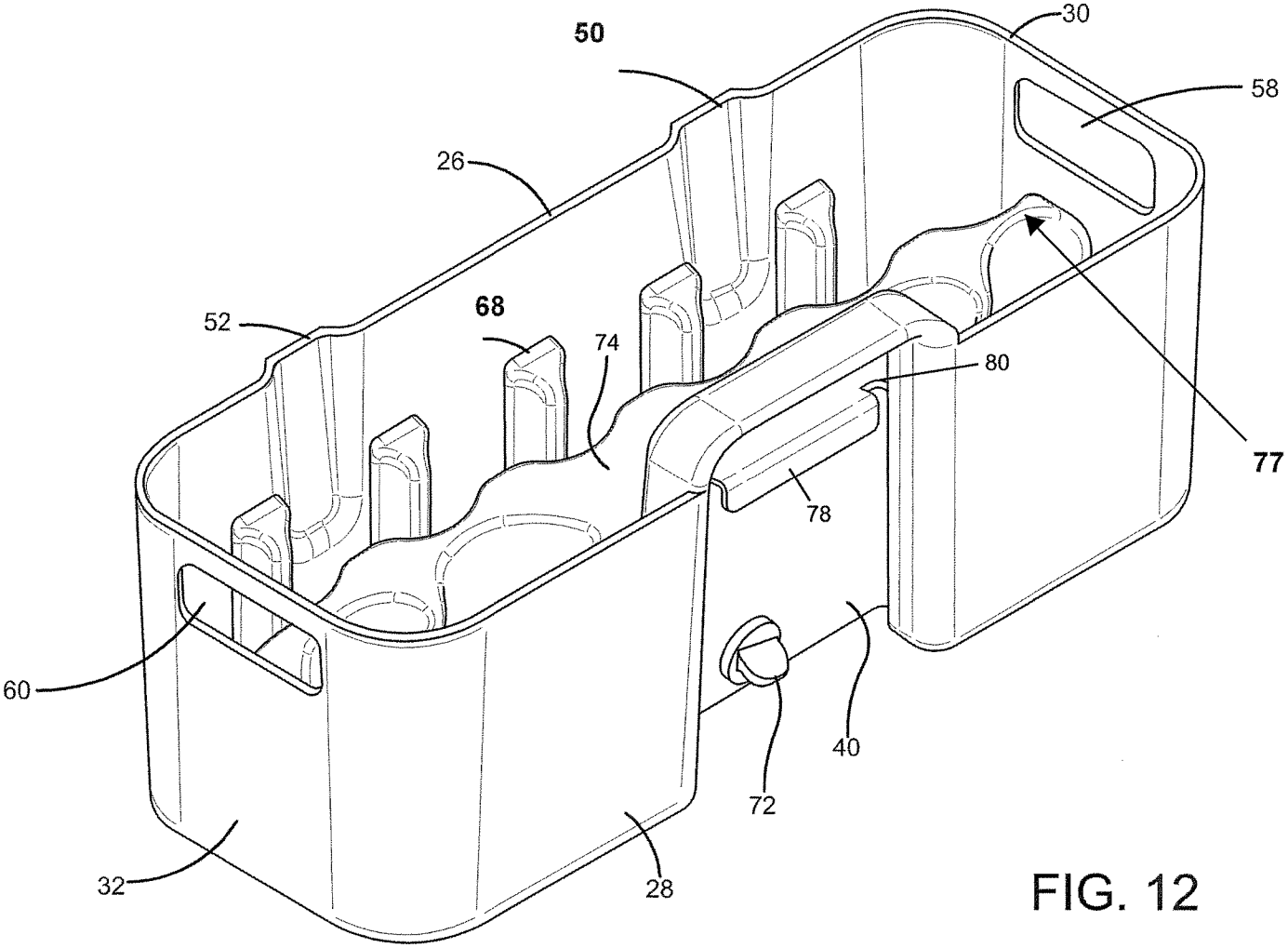
FIG. 12 is a top right perspective view of the exemplary beverage can holding container and alternative can divider structure.
Figure 13:
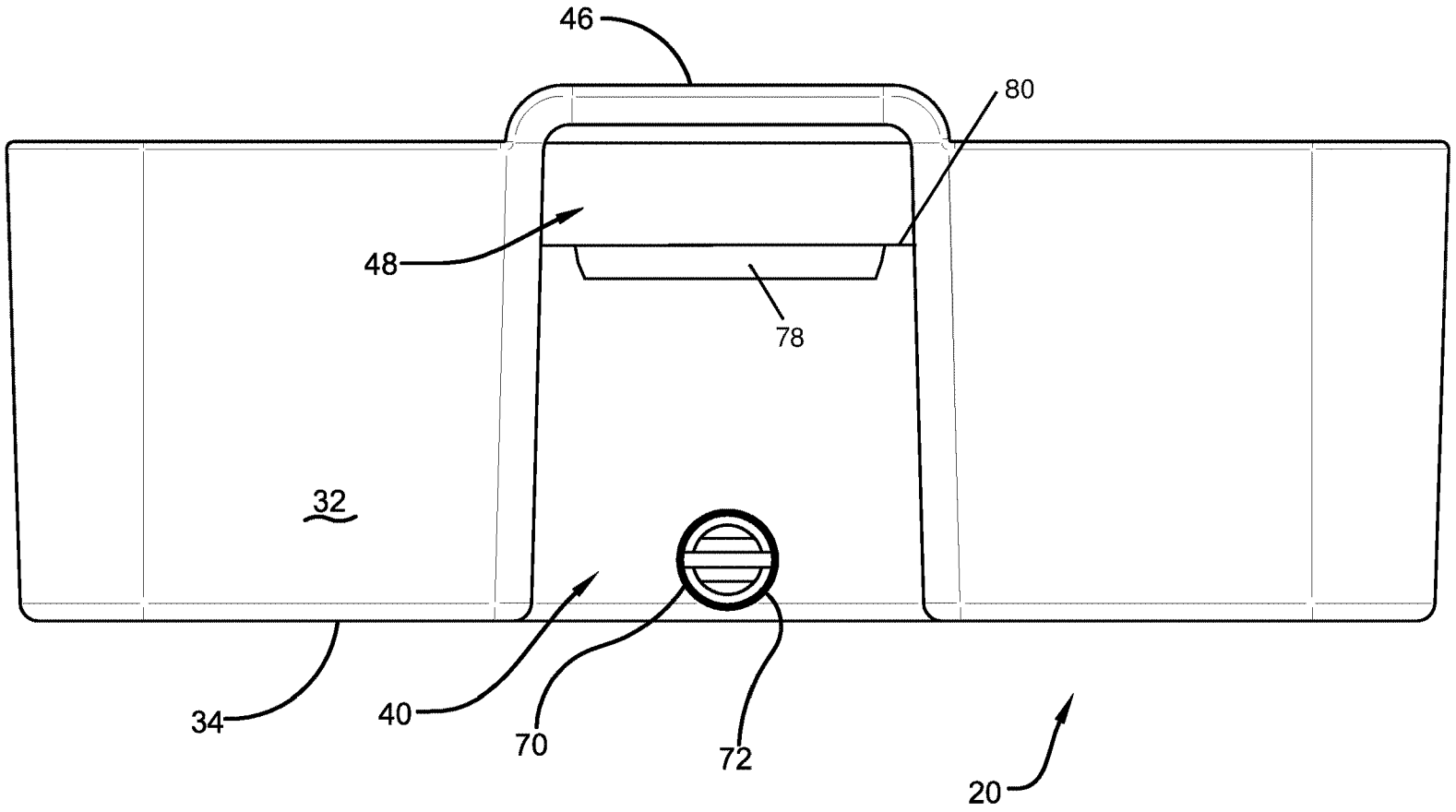
FIG. 13 is a top view of the exemplary beverage can holding container with the alternative can divider structure therein.
Figure 14:
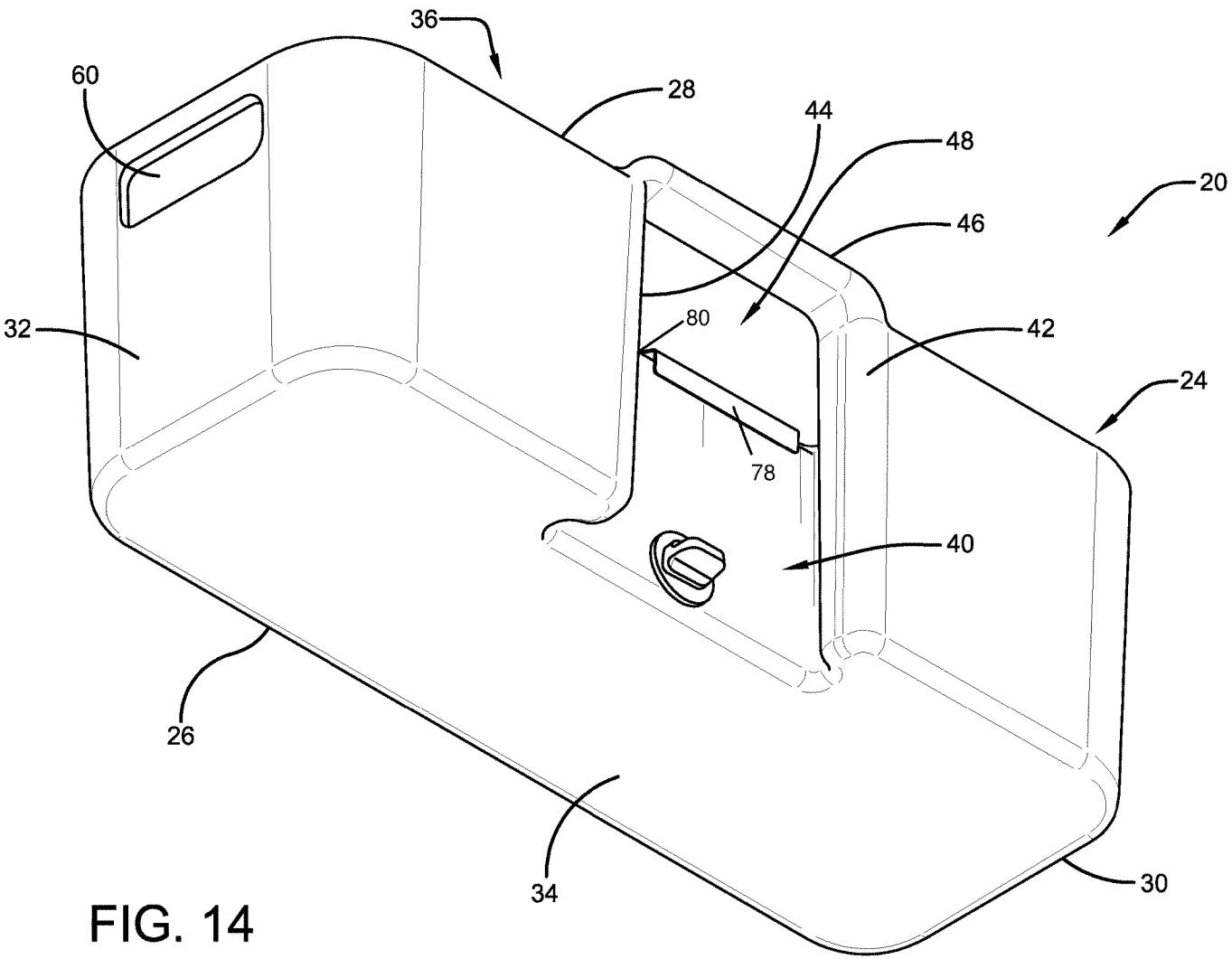
FIG. 14 is a back right top perspective view of the beverage can holding container and alternative can divider structure.

Divider 74 includes a central portion 76. A hook 78 extends from the central portion. As shown in FIGS. 12 and 13, the hook 78 is turned to overlie the forward edge 80 of wall 28 in the recess 40. Hook 78 extends at the bottom of the opening 48 below the handle 46.

Figure 3:
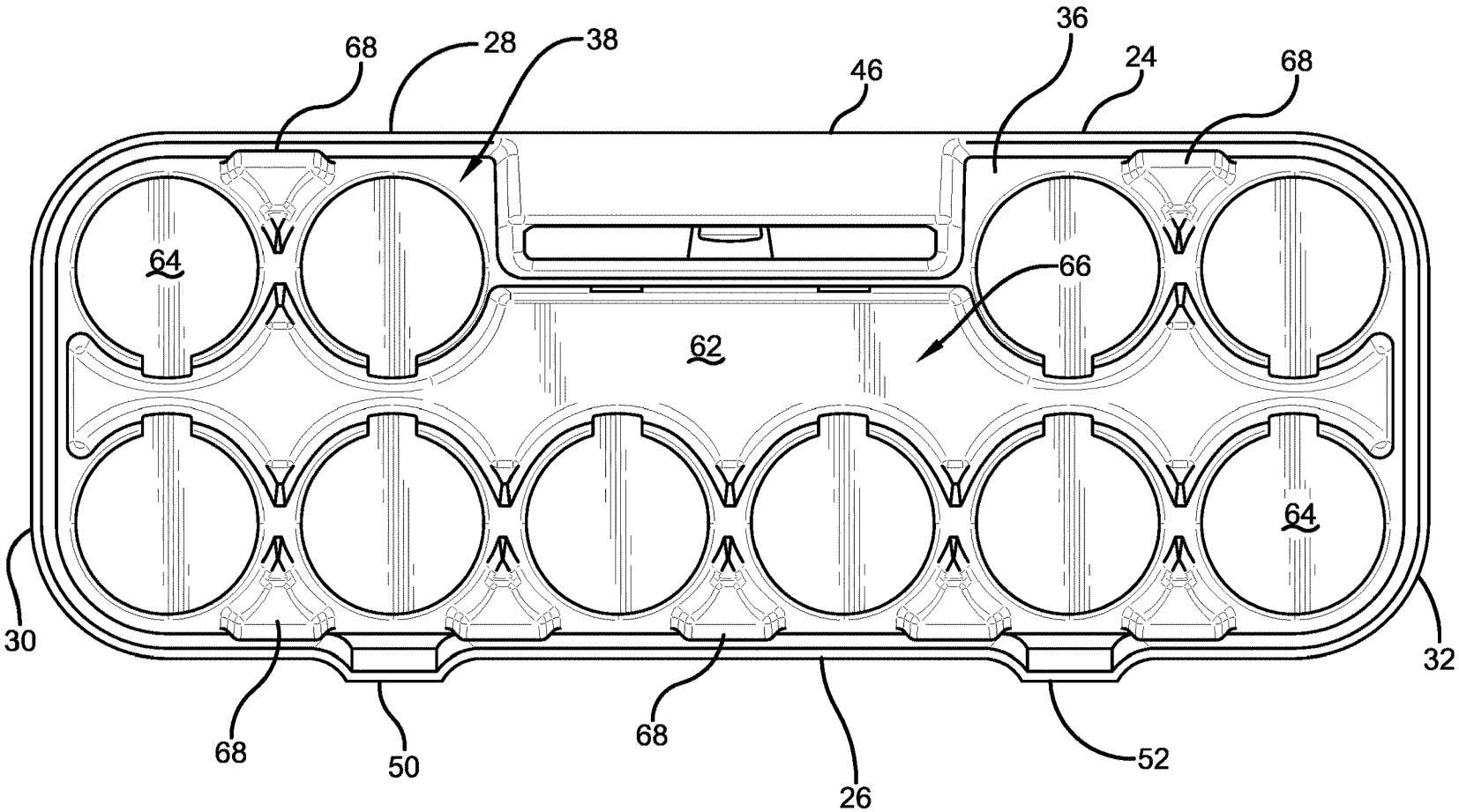
FIG. 3 is a front plan view of the exemplary beverage can holding container.
Figure 4:
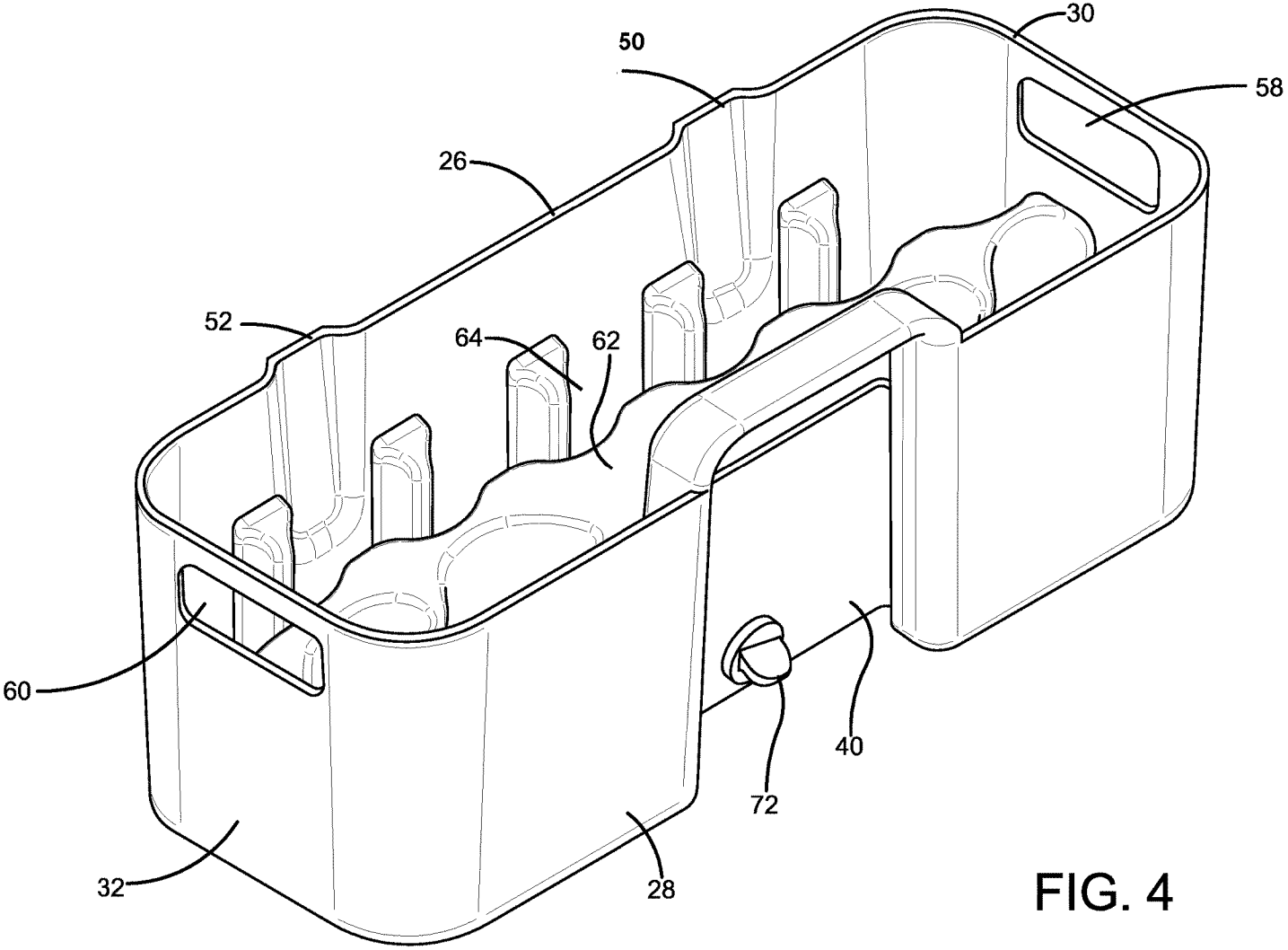
FIG. 4 is a top right perspective view of the exemplary beverage can holding container.
Figure 5:
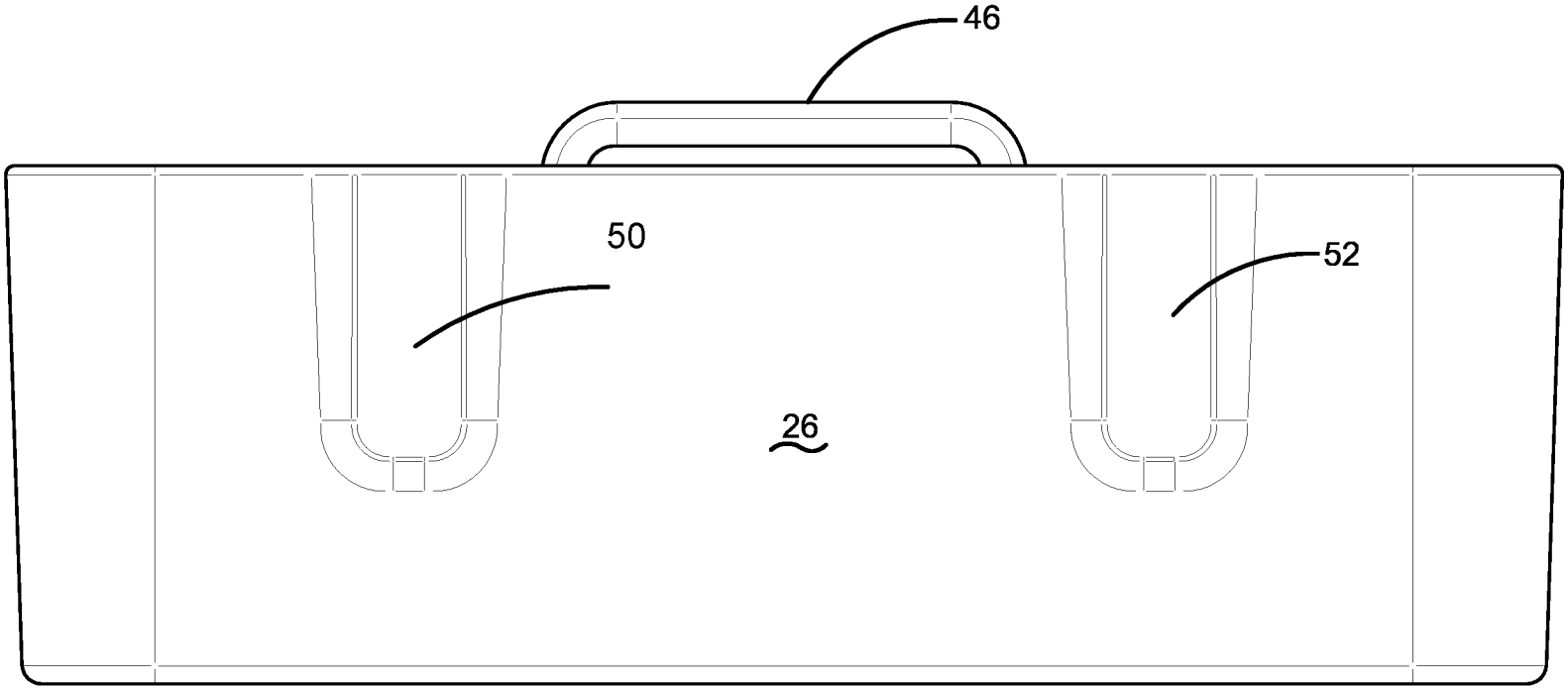
FIG. 5 is a bottom view of the beverage can holding container.
Figure 10:
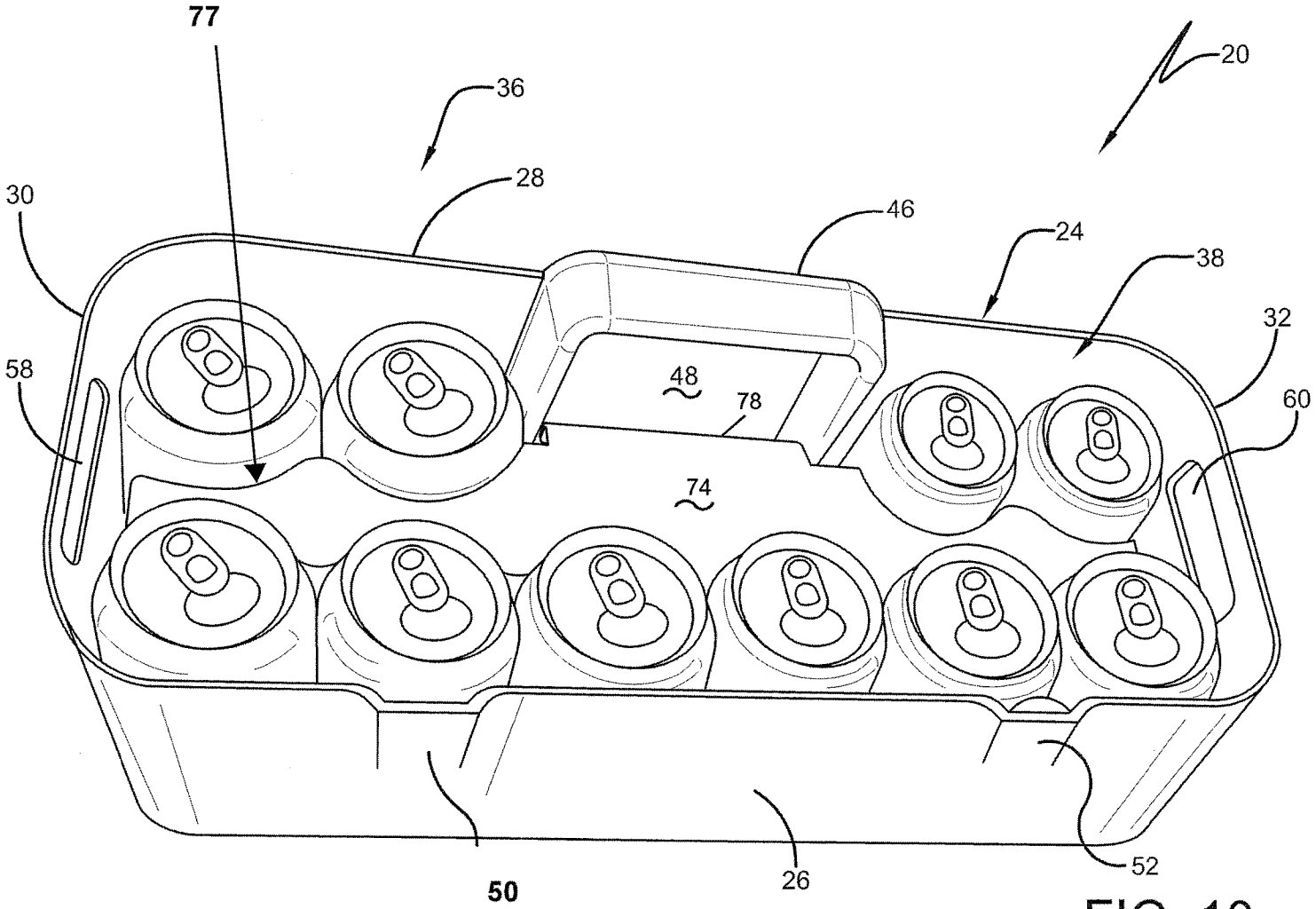
FIG. 10 is a top left perspective view of an exemplary beverage can holding container with an alternative can divider structure therein.
Figure 11:
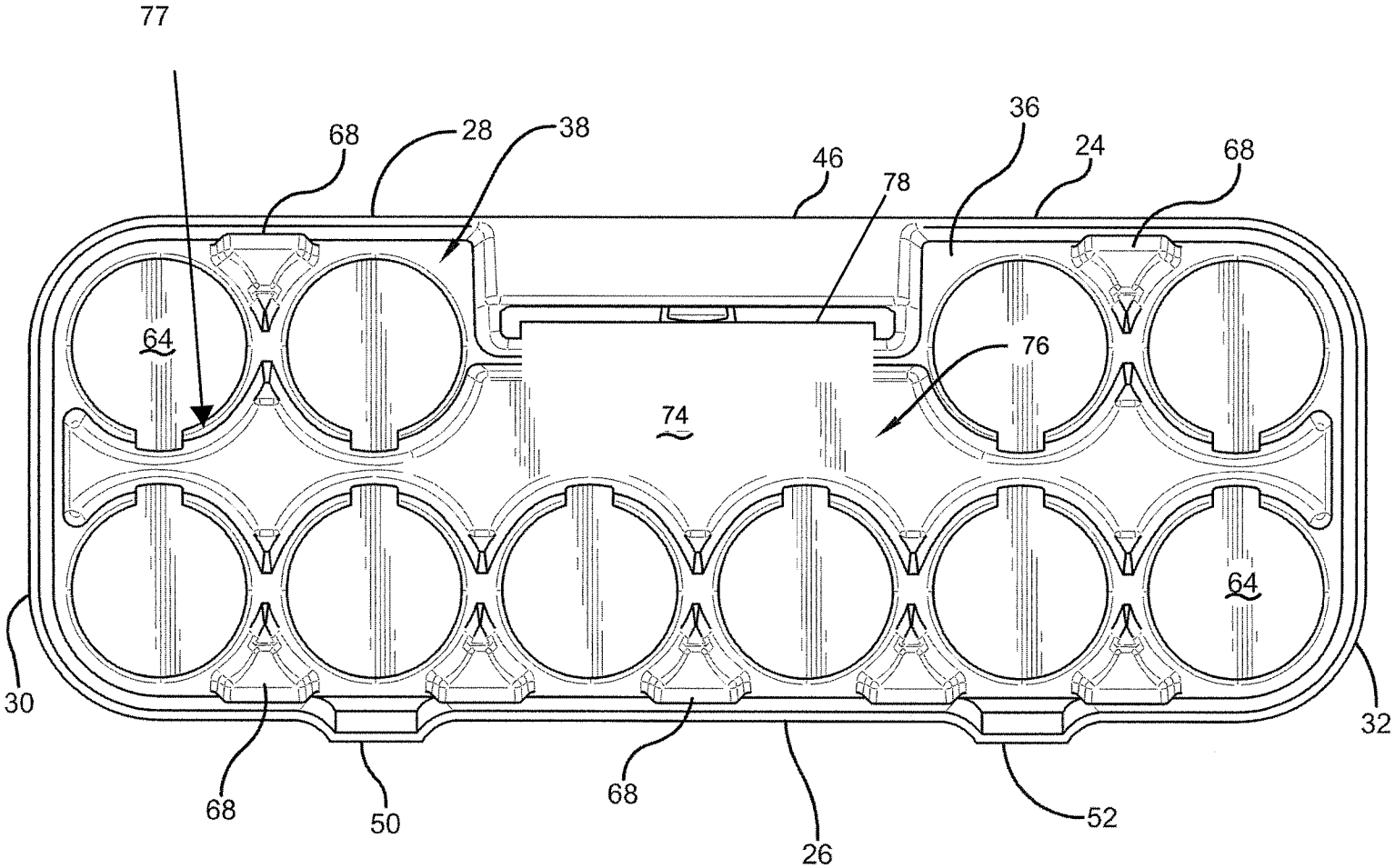
FIG. 11 is a front plan view of the exemplary beverage can holding container with the alternative can divider structure.

In the exemplary arrangement, the divider 74 includes a hook 78. The hook 78 is in operative engagement with the second wall 28 when the divider 74 is positioned in the interior area 36. When the divider 74 is positioned fully inward within the container, the hook 78 engages wall 28 and supports the weight of the cans that are positioned in the upper row of the can recesses each bounded by can supporting faces 77 as shown in FIGS. 10 and 11. This alternative divider configuration helps to distribute the weight of the cans within the container more evenly between walls 26 and 28 compared to divider 62 when the container is in the positions shown in FIGS. 3 and 11. This is because the exemplary divider 62 is configured to cause the weight of all the cans to be borne by the first wall 26. Depending on the configuration of the container, the materials from which it is constructed and the weight of the cans, this may cause the wall 26 to bow or otherwise deform. The exemplary divider 74 because of the engagement of the hook 78 with wall 28 distributes the load between the two walls and reduces the risks of the deformation of wall 26. Of course this approach is exemplary and in. other embodiments, other approaches may be used.

In an exemplary arrangement, the user of a refrigerator may position their beverage holding cans generally horizontally within the container positioned within the refrigerator to provide for the cooling thereof. The user may open the refrigerator and manually engage and remove cans from the container recesses 64 one at a time by moving the cans generally horizontally as the user desires to remove single cans of beverage.

Figure 8:
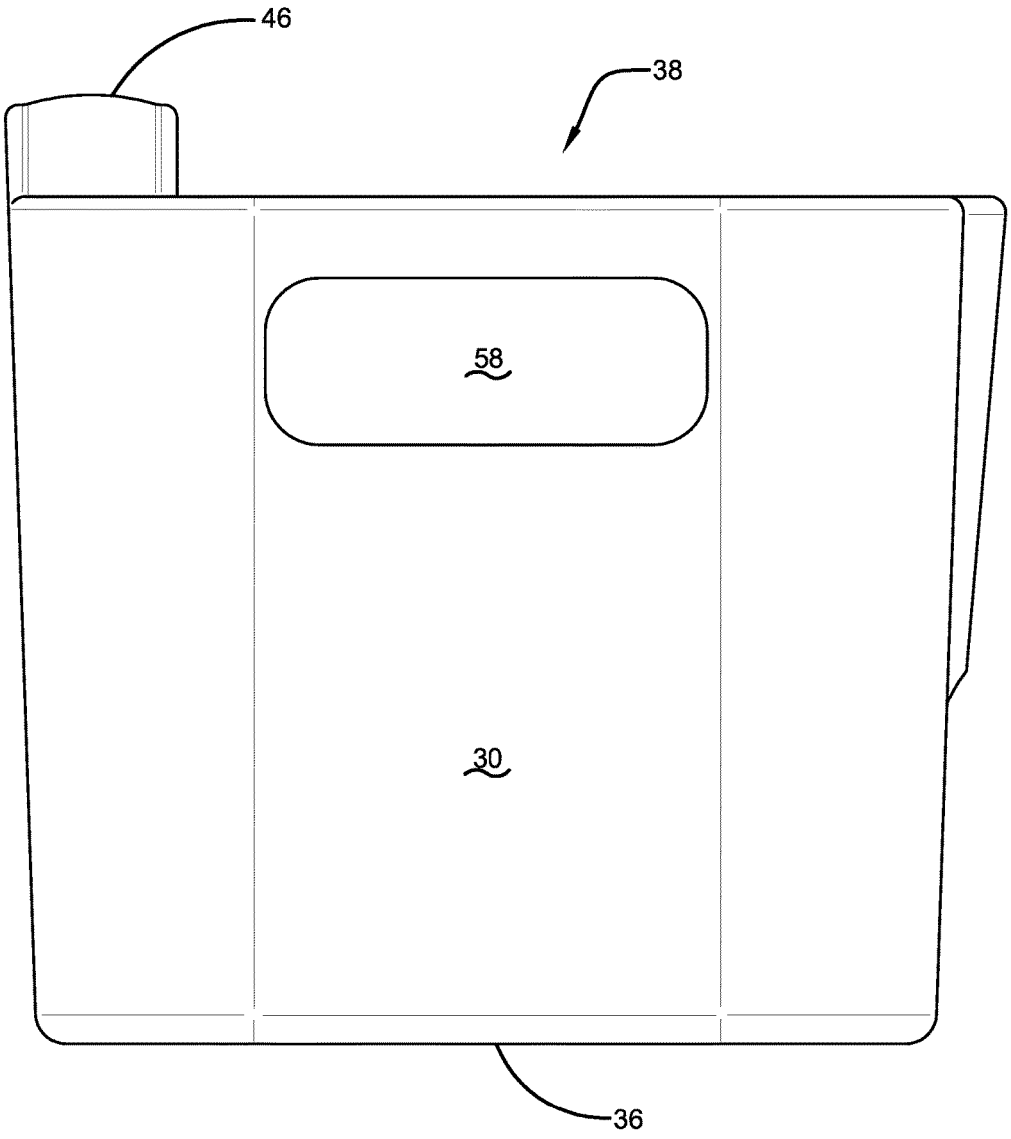
FIG. 8 is a side view of the exemplary beverage can holding container.

If the user wishes to transport a plurality of beverage holding cans to a remote location, the user may manually grab the handle 46 or handles 58 and 60 and remove the container 20 from the refrigerator. In the exemplary arrangement the user may move the container generally horizontally outwardly in engagement with the shelf and then move the container upwardly and out of the refrigerator. When the container is supported by the handle 46 (or handles 58 and 60) the cans are urged downwardly by gravity generally perpendicular to the closure wall. The user can then transport the container by manual engagement with the handles in an upright position as shown in FIG. 8 with the closure wall 34 at the underside of the container. As previously mentioned, the user can also fill the top opening of the container with ice or other cooling material to keep the beverage cans in the container cool for an extended period of time outside of the refrigerator.

Further in exemplary arrangements, the user may find it convenient to remove the container 20 from the refrigerator and place it with the outside of the closure wall on a table or other horizontal surface for purposes of loading beverage cans vertically into the can recesses 64. Once the user has loaded a plurality of cans into the can recesses, the container 20 may be carried by one or more of the handles and placed in the interior area of the refrigerator. The exemplary container 20 is positioned with the ramp surfaces 50, 52 of the wall 26 in supporting engagement with the horizontal shelf surface 18 and moved horizontally inwardly so that the container is within the refrigerator interior so the door may be in the closed position. This approach avoids the need for the user to make several trips to place beverage cans within the can holding recesses. Of course these approaches are exemplary and in other embodiments, other approaches may be used.

Thus the elements, features and characteristics of the exemplary embodiments described herein achieve desirable results, eliminate difficulties encountered in the use of prior devices and systems, solve problems and attain one or more useful objectives as stated above.

In the foregoing description, certain terms have been used for brevity, clarity and understanding. However, no unnecessary limitations are to be implied therefrom because such terms are used for descriptive purposes and are intended to be broadly construed. Moreover the descriptions and illustrations given herein are by way of examples and the useful features are not limited to the exact details shown and described.

Further, the descriptions herein which refer to left/right, top/bottom, front/back or similar terms indicating relative locations of items shall not be deemed limiting and it shall be understood that exemplary embodiments can be configured and used in numerous different orientations.

Having described the features, discoveries and principles of the exemplary embodiments, the manner in which they are constructed, operated and utilized, and the advantages and useful results attained, the new and useful structures, devices, elements, arrangements, parts, combinations, systems, equipment, operations, methods, processes and relationships are set forth in the appended claims.

We claim:

1. Apparatus comprising:

a container, wherein the container is configured to house a plurality of beverage cans and be removably positioned on a generally horizontal shelf surface within a refrigerator interior, the container including a housing, the housing including a generally rigid first wall, a generally rigid second wall disposed from and generally parallel to the first wall, a generally rigid first end wall, wherein the first end wall extends generally perpendicular to and between the first wall and the second wall, a generally rigid second end wall, wherein the second end wall extends generally perpendicular to and between the first wall and the second wall, wherein the second end wall is disposed from the first end wall, a closure wall, wherein the closure wall extends between the first wall, the second wall, the first end wall and the second end wall, wherein the housing bounds an interior area and includes an opening to the interior area opposite the closure wall, wherein the interior area is sized to hold the plurality of beverage cans therein, at least one ramp surface, wherein the at least one ramp surface is in attached connection with the first wall, wherein the at least one ramp surface is configured such that when the first wall is operatively supported on a generally horizontal surface, at least one interior can supporting face in operative connection with the first wall is slanted downward toward the closure wall, a divider removably positioned in the interior area, wherein the divider includes at least one divider can supporting face configured to support at least one beverage can that is engaged with the divider in the interior area, wherein the divider includes a hook, wherein the hook is releasibly engageable with the second wall, wherein the hook is in engagement with the second wall when the divider is positioned in the interior area, at least one handle, wherein the at least one handle is operatively connected to one of the first wall, the second wall, the first end wall and the second end wall, whereby when the container is supported on the generally horizontal shelf surface within a refrigerator interior with the at least one ramp surface in engagement with such shelf surface, the at least one ramp surface causes cans in the interior area to be urged downward toward the closure wall, and wherein when the container is so supported on the generally horizontal shelf surface, the divider is engaged with the second wall through engagement of the hook with the second wall, whereby weight of at least one beverage can engaged with the at least one divider can supporting face is borne by the second wall, and wherein the container is removable from the refrigerator interior by manual engagement of the at least one handle, and wherein the container is configured so that when carried by the at least one handle and the closure wall is positioned below the opening to the interior area, beverage cans in the interior area are urged downward toward the closure wall.

2. The apparatus according to claim 1 wherein the at least one ramp surface extends outward on an exterior side of the first wall outside the interior area.

3. The apparatus according to claim 2 wherein one handle of the at least one handle is attached to the second wall.

4. The apparatus according to claim 3 wherein the one handle is integrally formed with the second wall.

5. The apparatus according to claim 3 wherein the at least one handle includes a respective and e attached to each of the first end wall and the second end wall.

6. Apparatus comprising:

a container, wherein the container is configured to house a plurality of beverage cans and be removably positioned within a refrigerator, the container including a housing, the housing including a generally rigid first wall, a generally rigid second wall disposed from and generally parallel to the first wall, a generally rigid first end wall, wherein the first end wall extends generally perpendicular to and between the first wall and the second wall, a generally rigid second end wall, wherein the second end wall extends generally perpendicular to and between the first wall and the second wall, wherein the second end wall is disposed from the first end wall, a closure wall, wherein the closure wall extends between the first wall, the second wall, the first end wall and the second end wall, wherein the housing bounds an interior area and includes an opening to the interior area opposite the closure wall, wherein the interior area is sized to hold the plurality of beverage cans therein, wherein the second wall includes a recess that extends in the interior area toward the first wall, Wherein the recess is bounded by two bounding walls that extend generally perpendicular of the second wall, at least one ramp surface, wherein the at least one ramp surface is in operative connection with the first wall, and extends outward on an exterior side of the first wall outside the interior area wherein the at least one ramp surface is configured such that when the first wall is operatively supported on a generally horizontal surface, at least one interior can supporting face in operative connection with the first wall is slanted downward toward the closure wall, a handle, wherein the handle is integrally formed with each of the two bounding walls, wherein the container is configured to be supported on a generally horizontal shelf surface within a refrigerator interior and wherein when the container is so supported, the at least one ramp surface causes the plurality of cans in the interior area to be urged downward toward the closure wall, and wherein the container is removable from the refrigerator interior by manual engagement of the handle, and when the container is carried by the handle the plurality of beverage cans area urged downward toward the closure wall.

7. The apparatus according to claim 6 at least one divider within the interior area, wherein the at least one divider includes the at least one can supporting face.

8. The apparatus according to claim 6 wherein each of the first end wall and the second end wall include a handle engaging opening integrally formed therein.

9. The apparatus according to claim 6 wherein the interior area is configured to hold cylindrical beverage cans with a central axis thereof extending generally perpendicular to the closure wall.

10. The apparatus according to claim 9 and further including:

at least one divider positioned in the interior area, wherein the at least one divider is configured to engage at least one beverage can and urge the central axis thereof to extend generally perpendicular to the closure wall.

11. The apparatus according to claim 10 wherein the at least one divider is configured to engage a plurality of cans in the interior area.

12. The apparatus according to claim 11 wherein the one divider is selectively removable from the interior area.

13. The apparatus according to claim 12 wherein the second wall includes an edge that bounds the opening, wherein the divider includes a hook, wherein the hook engages the edge when the divider is in the interior area.

14. The apparatus according to claim 10 wherein at least one of the first wall, second wall, first end wall, second end wall and closure wall includes a drain opening configured to be closed by a movable drain plug.

15. The apparatus according to claim 14 wherein the drain opening is positioned in the second wall between the bounding walls and disposed from the handle that is integrally formed with the bounding walls.

16. The apparatus according to claim 15 and further including the refrigerator, wherein the refrigerator includes the horizontal shelf, wherein the refrigerator includes the refrigerator interior, a refrigerator opening to the refrigerator interior, a door movably mounted relative to the refrigerator opening, when the door is movable between a dosed position in which the door closes the refrigerator opening and an open position in which the door is disposed away from the refrigerator opening, wherein in the open position of the door with the housing stationary in the refrigerator interior and supported by the shelf, a can in the interior area of the housing is individually manually horizontally removable from the interior area and the refrigerator interior, or alternatively the housing including the can in the interior area, is removable from the refrigerator interior by manual engagement of the handle integrally formed with the bounding walls, and movement of the housing to disengage from the shelf and out of the refrigerator interior.

17. The apparatus according to claim 6 and further comprising a respective handle attached to each of the first end wall and the second end wall.

18. The apparatus according to claim 17 wherein each of the first end wall and the second end wall include a handle engaging opening integrally formed therein.

19. The apparatus according to claim 6 wherein the interior area is configured to hold a plurality of cylindrical beverage cans with a central axis of each can extending generally perpendicular to the closure wall.

20. The apparatus according to claim 19 and further including:

at least one divider positioned in the interior area, wherein the at least one divider is configured to engage at least one beverage can and urge the container axis thereof to extend generally perpendicular to the closure wall.

21. The apparatus according to claim 20 wherein at least one divider is selectively removable from the interior area.

22. The apparatus according to claim 19 wherein the at least one divider includes a hook, wherein the hook is in operative engagement with the second wall when the at least one divider is positioned in the interior area, wherein when the container is in the horizontal position supported on the shelf surface, at least one can in the interior area is operatively supported by the second wall through engagement of the hook and the second wall.

23. The apparatus according to claim 6 wherein at least one of the first wall, the second wall, the first end wall, the second end wall and the closure wall includes a drain opening configured to be closed h a movable drain plug.

24. The apparatus according to claim 6 wherein the handle and the at least one ramp surface are integrally formed with the container housing.

25. The apparatus according to claim 6 and further including the refrigerator, wherein the container is movable horizontally with the at least one ramp surface in engagement with the shelf and with the closure surface extending generally vertically.

26. Apparatus comprising:

a container, wherein the container is configured to house a plurality of beverage cans, wherein the container is configured to hold a plurality of beverage cans within an interior area of the container when positioned in supported connection with a horizontal shelf within a refrigerator and when removed from the refrigerator, wherein the container includes a housing wherein the housing includes at least one side wall hounding the interior area, a closure wall extending between the side walls, an opening to the interior area opposite the closure wall, at least one ramp surface extending outward from at least one side wall on a side of the housing, a handle in operative connection with the housing, wherein the handle is connected to the housing on a further side wall of the housing opposed of the side wall that includes the at least one ramp surface, wherein the further side wall includes a recess that extends in the interior area toward the side all that includes the at least one ramp surface, wherein the recess is bounded by two bounding walls that extend generally perpendicular to the further side wall, and wherein the handle is integrally formed with the bounding walls, wherein with the container supported on a horizontal shelf within the refrigerator with the at least one ramp surface in abutting relation with the shelf all cans within the interior area are slanted downwardly within the interior area and urged toward the closure wall, and each can is manually removable horizontally from the interior area, and the container is manually engageable by the handle to disengage from the shelf and he carried by the handle outside the refrigerator.

27. Apparatus comprising:

a container, wherein the container is configured to house a plurality of beverage cans and be removably positioned within a refrigerator, the container including a housing, the housing including a generally rigid first wall, a generally rigid second wall disposed from and generally parallel to the first wall, a generally rigid first end wall, wherein the first end wall extends generally perpendicular to and between the first wall and the second wall, a generally rigid second end wall, wherein the second end wall extends generally perpendicular to and between the first wall and the second wall, wherein the second end wall is disposed from the first end wall, a closure wall, wherein the closure wall extends between the first wall, the second wall, the first end wall and the second end wall, wherein the housing bounds an interior area and includes an opening to the interior area opposite the closure wall, wherein the interior area is sized to hold the plurality of beverage cans therein, at least one ramp surface, wherein the at least one ramp surface is integrally formed with the first wall and extends outwardly relative to the interior area, wherein the at least one ramp surface is configured such that when the first wall is operatively supported on a generally horizontal surface, at least one interior can supporting face in operative connection with the first wall in the interior area is slanted downward toward the closure wall, a first handle, wherein the first handle includes a manually engageable opening extending through the second wall to the interior area, and a pair of second handles, wherein each of the pair of second handles includes a manually engageable opening extending through a respective one of the first end wall and the second end wall to the interior area, wherein the container is configured to be supported on a generally horizontal shelf surface within a refrigerator interior and wherein when the container is so supported, the at least one ramp surface causes the at least one interior can supporting face to be slanted downward toward the closure wall such that the plurality of cans in the interior area in engagement with the at least one interior can supporting, face are urged downward toward the closure wall, and the manually engageable opening of the first handle extending through the second wall is disposed at an upper side of the container, and wherein the container is configured to be removable from the refrigerator interior by manual engagement of the manually engageable opening of the first handle in the second wall, and wherein when the container is carried by manual engagement of the manually engageable opening of the first handle, and the opening to the interior area is disposed above the closure wall, the plurality of beverage cans in the interior area are urged downward toward the closure wall.

* * * * *